US007067758B2

(12) United States Patent
Kruschke

(10) Patent No.: US 7,067,758 B2
(45) Date of Patent: Jun. 27, 2006

(54) ELECTRIC POWER CIRCUIT BREAKER COMPRISING A CONNECTING BAR AND AN ARCING HORN

(75) Inventor: Michael Kruschke, Schwante (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/510,686

(22) PCT Filed: Apr. 10, 2003

(86) PCT No.: PCT/DE03/01261

§ 371 (c)(1),
(2), (4) Date: Oct. 8, 2004

(87) PCT Pub. No.: WO03/092026

PCT Pub. Date: Nov. 6, 2003

(65) Prior Publication Data

US 2005/0151605 A1 Jul. 14, 2005

(30) Foreign Application Priority Data

Apr. 26, 2002 (DE) ..... 102 19 558

(51) Int. Cl.
*H01H 33/18* (2006.01)

(52) U.S. Cl. ..... 218/22; 218/36

(58) Field of Classification Search ..... 218/15–18, 218/22, 30, 34–43, 147–149, 153–157; 335/16, 335/147, 195, 201, 202
See application file for complete search history.

(56) References Cited

U.S. PATENT DOCUMENTS

| | | | | |
|---|---|---|---|---|
| 4,973,805 | A * | 11/1990 | Paton et al. | 218/40 |
| 5,075,520 | A * | 12/1991 | Mueller et al. | 218/36 |
| 5,210,385 | A * | 5/1993 | Morel et al. | 218/9 |
| 5,589,672 | A * | 12/1996 | Uchida et al. | 218/34 |
| 5,969,314 | A * | 10/1999 | Rakus et al. | 218/7 |
| 6,100,490 | A * | 8/2000 | Turkmen | 218/22 |
| 6,689,979 | B1 * | 2/2004 | Bach et al. | 218/40 |

FOREIGN PATENT DOCUMENTS

| | | |
|---|---|---|
| DE | 1 009 698 | 7/1954 |
| DE | 198 19 165 A1 | 10/1999 |
| DE | 199 32 010 C1 | 3/2001 |
| DE | 100 17 557 A1 | 4/2001 |
| EP | 0 400 442 A2 | 12/1990 |
| EP | 0 898 779 B1 | 3/1999 |
| EP | 0 948 009 A2 | 10/1999 |
| WO | WO 01/39225 A1 | 5/2001 |
| WO | WO 200139225 A1 * | 5/2001 |

* cited by examiner

*Primary Examiner*—Lincoln Donovan
*Assistant Examiner*—M. Fishman
(74) *Attorney, Agent, or Firm*—Harness, Dickey & Pierce, PLC

(57) ABSTRACT

An electric power circuit breaker includes a connecting bar against which an arcing horn rests with an attaching limb. The connecting bar extends through an opening of a rear wall of the housing. In order to connect the arching horn to the connecting bar, a projection is provided on the attaching limb of the arcing horn and a recess that accommodates the projection is provided on the connecting bar. When inserting the connecting bar with the arching horn resting thereon, the attaching limb of the arching horn is covered by a collar mounted on the housing. The attaching device grasp a fillet located on the underside of the connecting bar.

12 Claims, 2 Drawing Sheets

ELECTRIC POWER CIRCUIT BREAKER COMPRISING A CONNECTING BAR AND AN ARCING HORN

This application is the national phase under 35 U.S.C. § 371 of PCT International Application No. PCT/DE03/01261 which has an International filing date of Apr. 10, 2003, which designated the United States of America and which claims priority on German Patent Application number DE 102 19 558.7 filed Apr. 26, 2002, the entire contents of which are hereby incorporated herein by reference.

FIELD OF THE INVENTION

The invention generally relates to an electrical power circuit breaker having a housing and having a connecting bar accommodated in an opening in the housing. Preferably, it relates to one wherein the end of the connecting bar which protrudes into the housing is part of a switching contact arrangement and bears an arcing horn which has a fixing limb resting on the connecting bar.

BACKGROUND OF THE INVENTION

A power circuit breaker of the type mentioned is described, for example in DE 198 19 165 A1. In this case, a screw acts as a common fixing device for the connecting bar and the supported arcing horn, in order to simplify the assembly of these parts when producing the power circuit breaker. This takes place by a web arranged on the underside of the connecting bar being supported on the inner side of the housing. By this, the position of the inner end face, which is associated with the switching contact arrangement, of the connecting bar is determined.

Counter to inward movement of the connecting bar, a stop bar is provided on the arcing horn, and is supported on the outside of the housing of the power circuit breaker. The arcing horn and the connecting bar are connected to one another and at the same time fixed against being moved in both directions by way of fixing device engaging in the connecting bar and passing through the supported fixing limb.

For assembly purposes, the arcing horn is initially inserted in the opening, which is provided for the purpose of passing through the connecting bar, of the housing, in order to position the stop bar. The connecting bar is then inserted, the level of the opening in the housing thus corresponds to the overall level of the connecting bar and the fixing limb of the arcing horn.

SUMMARY OF THE INVENTION

An embodiment of the invention includes an object of simplifying the assembly of the connecting bar and arcing horn and of improving the accessibility of the fixing device for the arcing horn.

An object may be achieved according to an embodiment of the invention by at least one projection pointing toward the connecting bar being formed on the fixing limb of the arcing horn, and by the connecting bar having a recess corresponding to the projection.

This design of the connecting bar and the arcing horn makes it possible for the two parts to be brought into the relative position envisaged by way of the projection and the recess prior to assembly of the power circuit breaker in the housing, and to assemble both of them in the housing in this position. Connecting the arcing horn and the connecting bar by use of the abovementioned projection and the corresponding recess makes it possible to select a fixing device(s) engaging with the connecting bar. This has the advantage that the fixing device(s) can be attached at a point which is more effectively protected against the influence of switching arcs.

The projection provided on the fixing limb of the arcing horn may in the context of an embodiment of the invention be in the form of a bent-back edge, the recess provided for accommodating the projection being in the form of a groove. In particular when, according to a further feature of an embodiment of the invention, the fastening limb is as wide as the connecting bar, and the bent-back edge extends over the entire width of the fixing limb and the recess extends over the entire width of the connecting bar, a stable connection, which thus corresponds to the operational requirements, is achieved between the arcing horn and the connecting bar.

The opening provided in the housing for the power circuit breaker for the purpose of accommodating the connecting bar, as is also the case with the arrangement according to the above-mentioned DE 198 19 165 A1, be dimensioned such that the connecting bar and the fixing limb of the arcing horn are at the same levels. However, instead of this, according to a further development of an embodiment of the invention, the opening in the housing may be matched to the cross-sectional form of the connecting bar, and a collar which covers the fixing limb of the arcing horn at the top and at the sides may be integrally formed on the housing. Such a collar can be designed such that it extends in the vicinity of the arc-guiding part of the arcing horn and thus prevents a movement or movement.

As has already been mentioned, an embodiment of the invention avoids fixing device(s) which pass through the fixing limb of the arcing horn. For common fixing purposes, it is recommended to provide on the connecting bar an integrally formed web in the form of a stop device(s) on the housing, as is already known form DE 198 19 165 A1. This web is gripped and pushed against the housing by fixing device(s) which can be operated from the outside of the housing.

The invention is described in more detail below with reference to the exemplary embodiment illustrated in the figures.

DETAILED DESCRIPTION OF THE EXEMPLARY EMBODIMENTS

Figure 1:
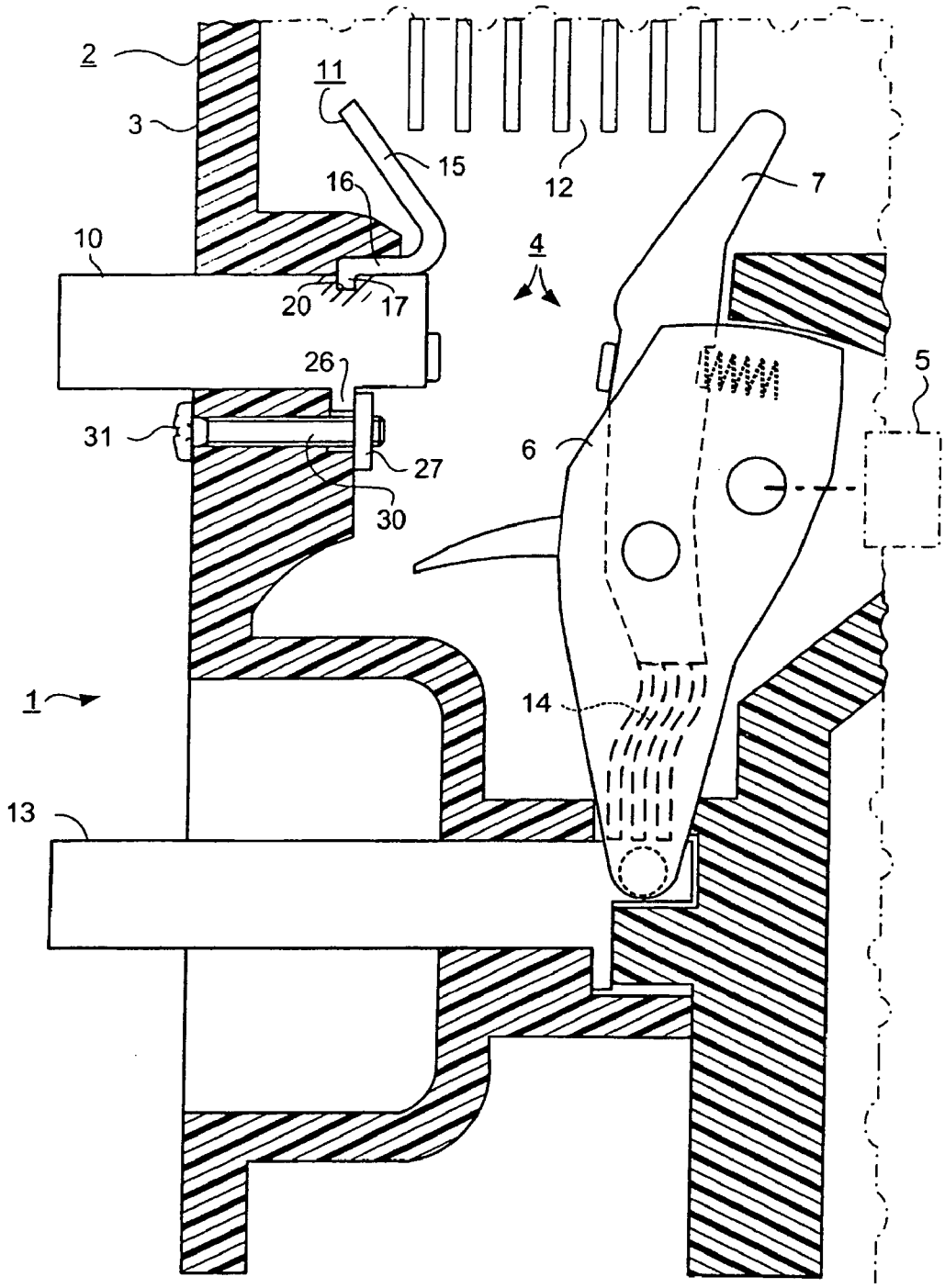
FIG. 1 shows a section through a region of a low-voltage power circuit breaker which is part of an embodiment of the invention.

The low-voltage power circuit breaker 1 shown in FIG. 1 has, in a known manner, a housing 2 having a rear wall 3 and preferably two or more switching contact arrangements 4. A drive device 5 serves the purpose of simultaneously actuating the switching contact arrangements 4. These each have a contact carrier 6 and a contact lever 7 arranged thereon such that it can move counter to the spring force. Contact pieces or contact faces interacting with the contact levers 6 are fitted to an upper connecting bar 10 which projects into the housing 2 and bears an arcing horn 11. Located above the switching contact arrangements 4 are arc-quenching chambers 12. In addition to the abovementioned upper connecting bars 10, lower connecting bars 13 which are connected to the contact levers 7 by means of flexible conductors 14 serve the purpose of connecting the switching contact arrangements 4 to an external circuit.

In addition, FIG. 1 shows a screwless connection of the arcing horn 11 to the upper connecting bar 10. The arcing horn 11 has a horn element 15, which serves the purpose of guiding switching arcs, and a fixing limb 16. The end of the fixing limb 16 is provided with a projection 17, which is in the form of a bent-back section, a recess 20 in the form of a groove being fitted to the upper side of the connecting bar 10 for the purpose of accommodating the projection 17. The fixing limb 16 and the connecting bar 10 have the same width. The recess 20 correspondingly extends over the entire width of the connecting bar 10.

Figure 2:
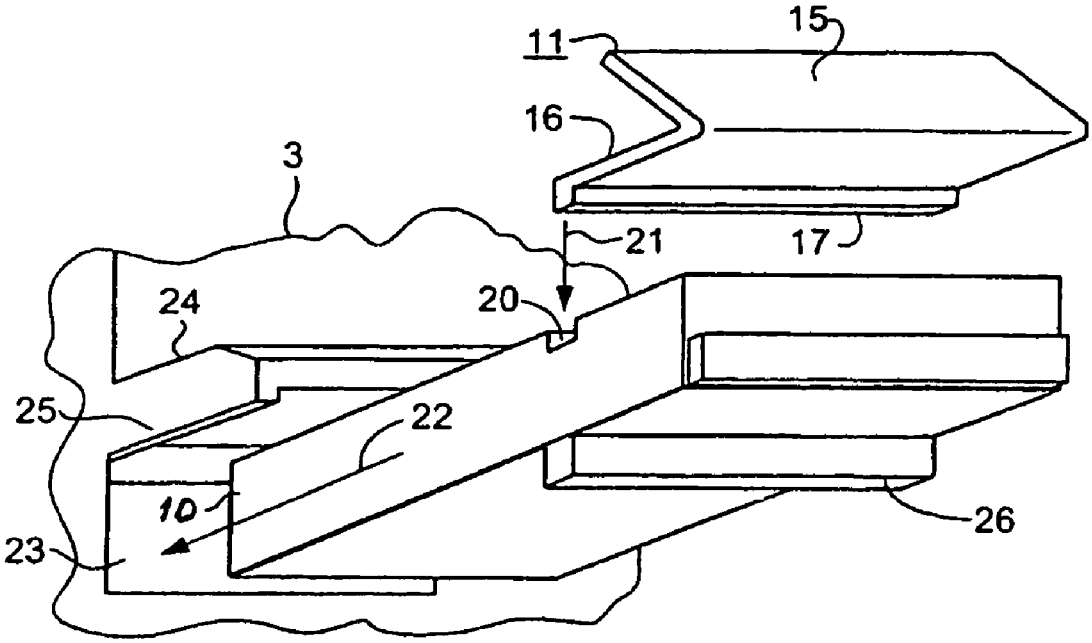
FIG. 2 shows an enlarged, perspective illustration of a detail of a housing of the low-voltage power circuit breaker shown in FIG. 1.

Further details and the procedure for assembly can be seen in more detail in FIG. 2 which shows an enlarged, perspective illustration of the region of the upper connecting bar 10 and the arcing horn 11. As is indicated by an arrow 21, for the purpose of connecting it to the connecting bar 10, the fixing limb 16 of the arcing horn 11 is brought to bear over a large area on the upper side of the connecting bar 10 such that the projection 17 is inserted into the recess 20 in the form of a groove. This assembly is then inserted into an opening 23 in the direction of a further arrow 32, the opening 23 being provided in the rear wall 3 of the housing 2 of the power circuit breaker 1. In this case, the opening 23 matches the connecting bar 10. In addition, a collar 24, which covers the fixing limb 16 and also overlaps the said fixing limb 16 laterally with lateral side pieces 25, is integrally formed on the rear wall 3 above the opening 23.

For the purpose of finally fixing the connecting bar 10 to the arcing horn positioned on it, fixing devices are provided which are accessible on the outside of the housing 2 or the rear wall 3. The arrangement of the fixing devices can be seen in more detail in FIG. 1. FIG. 1 shows how a web 26 arranged on the underside of the connecting bar 10 is gripped by a nut 27 in the form of a pressure piece. A retaining screw 30 which passes through the rear wall 3 engages in the nut 27 and presses the connecting bar 10 by use of its web 26 on the inside against the rear wall 3. In this case, a head 31 of the retaining screw 30 is located on the outside of the rear wall 3 and is thus easily accessible for use. The fixing limb 16 of the arcing horn 11, on the other hand, is free of fixing devices and is largely covered and protected on its upper side by the collar 24.

The further parts of a switching pole of a low-voltage power circuit breaker of those parts shown correspond to a conventional physical design as are described, for example, in EP 0 898 779 B1 and are therefore not described in any more detail.

The recess 20 in the connecting bar 10 may expediently be introduced when the connecting bar 10 is produced by way of profiling, in the same manner as the web 26. It is therefore tolerable to produce the recess 20 by separately machining the connecting bar 10.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electrical power circuit breaker comprising:

a housing;

a connecting bar, accommodated in an opening in the housing, the end of said connecting bar which protrudes into the housing being part of a switching contact arrangement and bearing an arcing horn which has a fixing limb resting on the connecting bar, wherein at least one projection pointing towards the connecting bar is formed on the fixing limb of the arcing horn, and wherein the connecting bar has a recess for the purpose of accommodating the projection, wherein a collar which covers the fixing limb of the arcing horn at the top and at the sides is integrally formed on the housing.

2. The power circuit breaker as claimed in claim 1, wherein the projection is in the form of a bent-back section on the fixing limb of the arcing horn, and wherein the recess of the connecting bar is in the form of a groove.

3. The power circuit breaker as claimed in claim 2, wherein the fixing limb is dimensioned to have the same width as the connecting bar, wherein the projection extends over the entire width of the fixing limb, and wherein the recess extends over the entire width of the connecting bar.

4. The power circuit breaker as claimed in claim 3, wherein the opening arranged in the housing of the power circuit breaker is dimensioned such that it is matched to the cross-sectional shape of the connecting bar.

5. The power circuit breaker as claimed in claim 1, wherein the connecting bar has an integrally formed web as a stop device on the housing, and wherein fixing devices, which grip the web and can be operated from the outside on the housing, are provided.

6. The power circuit breaker as claimed in claim 1, further comprising:

a web, integrally formed on the connecting bar as a stop on the housing; and fixing means for gripping the web and for being operated from the outside on the housing.

7. An electrical power circuit breaker comprising:

a switching contact arrangement including a connecting bar, accommodated in an opening of a housing, wherein an end of the connecting bar includes an arcing horn, a fixing limb of the arcing horn resting on the connecting bar and including at least one projection, and wherein the connecting bar includes a recess for accommodating the projection, wherein a collar which covers the fixing limb of the arcing horn at the top and at the sides is integrally formed on the housing.

8. The power circuit breaker as claimed in claim 7, wherein the projection is in the form of a bent-back section on the fixing limb of the arcing horn, and wherein the recess of the connecting bar is in the form of a groove.

9. The power circuit breaker as claimed in claim 8, wherein the fixing limb is dimensioned to have the same width as the connecting bar, wherein the projection extends over the entire width of the fixing limb, and wherein the recess extends over the entire width of the connecting bar.

10. The power circuit breaker as claimed in claim 9, wherein the opening arranged in the housing of the power circuit breaker is dimensioned such that it is matched to the cross-sectional shape of the connecting bar.

11. The power circuit breaker as claimed in claim 7, wherein the connecting bar has an integrally formed web as a stop device on the housing, and wherein fixing devices, which grip the web and can be operated from the outside on the housing, are provided.

12. The power circuit breaker as claimed in claim 7, further comprising:

a web, integrally formed on the connecting bar as a stop on the housing; and fixing means for gripping the web and for being operated from the outside on the housing.

* * * * *